US007147570B2

(12) United States Patent
Toulon et al.

(10) Patent No.: US 7,147,570 B2
(45) Date of Patent: Dec. 12, 2006

(54) METHOD FOR FITTING GOLF CLUBS

(75) Inventors: Sean Toulon, Vista, CA (US); Gary Gallagher, Oceanside, CA (US); A. J. Bonar, Vista, CA (US); Jose Miraflor, San Diego, CA (US); David Anderson, San Diego, CA (US); Benoit Vincent, Leucadia, CA (US); Michael Scott Burnett, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 786 days.

(21) Appl. No.: 09/949,212

(22) Filed: Sep. 7, 2001

(65) Prior Publication Data

US 2002/0119828 A1 Aug. 29, 2002

Related U.S. Application Data

(60) Provisional application No. 60/231,123, filed on Sep. 8, 2000.

(51) Int. Cl.
*A63B 53/04* (2006.01)

(52) U.S. Cl. ..... 473/290; 473/345; 473/409

(58) Field of Classification Search ..... 473/409, 473/287, 288, 289, 290, 291, 345
See application file for complete search history.

(56) References Cited

U.S. PATENT DOCUMENTS

| | | | | |
|---|---|---|---|---|
| 4,762,322 | A * | 8/1988 | Molitor et al. | 473/345 |
| 4,885,847 | A * | 12/1989 | Korfanta | 33/508 |
| 5,346,217 | A * | 9/1994 | Tsuchiya et al. | 473/345 |
| 5,421,098 | A * | 6/1995 | Muldoon | 33/334 |
| 5,452,890 | A * | 9/1995 | Bingman | 473/310 |
| 5,830,077 | A * | 11/1998 | Yavitz | 473/224 |
| 5,974,645 | A * | 11/1999 | Currie | 29/33 R |
| 6,192,323 | B1 * | 2/2001 | Boehm | 264/219 |
| 6,193,614 | B1 * | 2/2001 | Sasamoto et al. | 473/329 |
| 6,248,025 | B1 * | 6/2001 | Murphy et al. | 473/324 |
| 6,325,728 | B1 * | 12/2001 | Helmstetter et al. | 473/328 |
| 6,364,788 | B1 * | 4/2002 | Helmstetter et al. | 473/324 |
| 6,435,977 | B1 * | 8/2002 | Helmstetter | 473/290 |

* cited by examiner

*Primary Examiner*—Stephen Blau
(74) *Attorney, Agent, or Firm*—Sheppard, Mullin, Richter & Hampton LLP

(57) ABSTRACT

A method is disclosed for effectively guiding golfers and/or their fitting professionals toward the selection of a particular wood-type golf club that is optimally matched or fitted to each golfer's particular swing characteristics, the selection being made from a set of golf clubs having at least three different head sizes and being made based on one or more swing characteristics for the golfer.

34 Claims, 3 Drawing Sheets

METHOD FOR FITTING GOLF CLUBS

This application claims the benefit of Provisional Application No. 60/231,123, filed 09/08/2000.

BACKGROUND OF THE INVENTION

This invention resides in a method for fitting individual golfers with wood-type golf clubs that are optimally matched to their skill levels and swing characteristics.

In the past, golfers typically have selected a particular wood-type golf club, i.e., a driver or fairway wood, for purchase and use, simply by using the club to hit a number of golf balls at a driving range or in one or more rounds of golf. The golfer then decides whether or not to purchase the club simply by subjectively assessing the club's performance. Sometimes, the golfer might similarly test one or more other golf clubs, as well, such other club differing slightly from the first club, for example, by having a different shaft flex, a different swing weight, and/or a different loft angle.

Although the club selection procedure described briefly above sometimes results in an proper fit for the particular golfer, it very frequently does not. Moreover, even when a golfer is subjectively satisfied with the performance of the selected golf club, there remains an uncertainty that the club might not be the optimum club for that golfer's particular swing characteristics.

It should, therefore, be appreciated that there is a need for a systematic method for selecting an optimum wood-type golf club from a set of golf clubs, particularly a set of golf clubs having at least three different head sizes, as well as different loft angles and different shaft flexes. The present invention satisfies this need and provides further related advantages.

SUMMARY OF THE INVENTION

The present invention resides in a method of optimally selecting a wood-type golf club for a golfer from a set of golf clubs having at least three different head sizes, each club having a head volume of at least 300 cc. In the method, a value is first determined for at least a first swing characteristic for the golfer, after which an optimal golf club is selected from the set, such selection being based on the value of at least the first swing characteristic.

More particularly, in a first step of the method, a first golf club is selected, having a first head size, a first loft angle, and a first shaft flex, and the golfer then swings this first golf club more than one time, to obtain a value representing at least a first swing characteristic. Then, a second golf club is selected based upon the value representing at least the first swing characteristic, the second golf club having a second head size, a second loft angle, and a second shaft flex. The golfer then swings this second golf club to hit a plurality of golf balls and obtain a value representing a second swing characteristic. Thereafter, the golfer swings a third golf club to hit a plurality of additional golf balls and obtain a value representing a third swing characteristic, to validate the selection of the second golf club, the third golf club having a third head size, a third loft angle, and a third shaft flex. Finally, an optimal golf club is selected from the set of golf clubs, the optimal golf club having a first, second or third head size, a first, second or third loft angle, and a first, second or third shaft flex.

In more detailed features of the invention, the value for at least the first swing characteristic is an average swing speed of the golfer, and the second and third swing characteristics are the same, e.g., ball launch angle or spin rate. A relationship between the average swing speed, optimal ball launch angle, and spin rate is predetermined, such that the selecting steps can be performed simply by referring to a chart.

In other, more detailed features of the invention, the method can further includes steps of selecting and swinging a fourth golf club having a fourth head size, a fourth loft angle, and a fourth shaft flex, and a fifth golf club having a fifth head size, a fifth loft angle, and a fifth shaft flex. This is done to further validate the selection of the second golf club. The optimal golf club then has an optimal head size corresponding to the first, second, third, fourth, or fifth head size, an optimal loft angle corresponding to the first, second, third, fourth or fifth loft angle, and an optimal shaft flex corresponding to the first, second, third, fourth or fifth shaft flex.

In an alternative feature of the invention, face tape can be applied to the first golf club and the golfer can swing the club to strike several golf balls, resulting in the formation of a dispersion pattern on the face tape. This dispersion pattern can be used to aid in selecting the optimal golf club.

The set of golf clubs preferably has club heads having volumes of at least 300 cc, preferably differing from each other by at least 20 cc. In addition, the golf clubs preferably have substantially similar engravings on their heads, to indicate a common source. These substantially similar engravings can take the form of a scoreline pattern on the face of each club head, and/or a brand marking or logo on each club head.

The set of golf clubs also can all have a similar finish on their heads, and/or they can have a substantially common construction. For example, the heads all can have a cast body and a face plate welded to a front opening of the cast body. In addition, the substantially common construction can take the form of a common material being used for at least a body portion of each club head. The substantially common construction also can include a recess located on exterior of a body portion of each club head in the set, the recess fixedly receiving a swing weight, and/or it can include an insert located in a hosel portion of the club head.

The set of golf clubs represent different head styles, having at least two different address planforms, the planforms being different in size and/or shape. Size differences can take the form of different ratios of face height to head depth, and/or different face aspect ratios. In addition, the different head styles further can have at least two different weight pads, differing in size and/or location. The different head styles further can be formed from at least two different materials. For example, one or more head styles can comprise a titanium alloy, while one or more other head styles can comprise a stainless steel alloy. The club heads of the set of golf clubs all preferably have coefficient of restitution values of at least 0.8.

Other features and advantages of the present invention should become apparent from the following detailed description, taken in conjunction with the accompanying drawings, which disclose, by way of example, the preferred method of the invention.

DETAILED DESCRIPTION OF THE PREFERRED METHODS OF THE INVENTION

Figure 1:
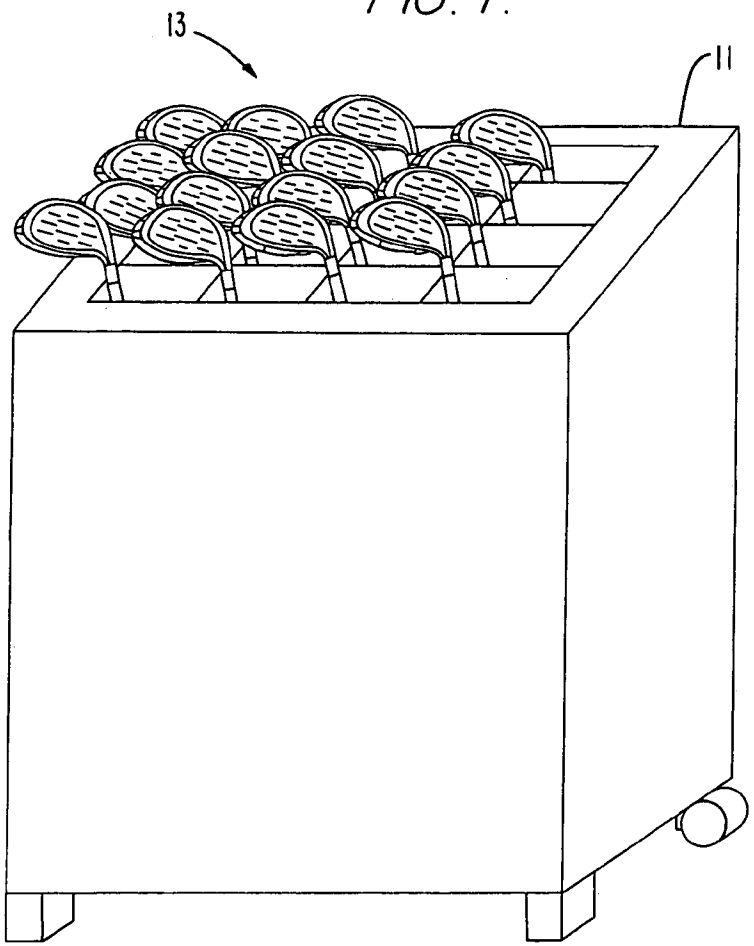
FIG. 1 is a perspective view of a portable cart carrying a preferred set of golf clubs, from which an optimum club is selected for a golfer according to the method of the invention.
Figure 5:
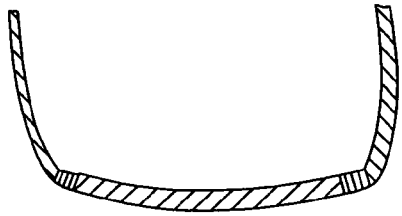
FIG. 5 is a sectional view of the face portion of the driver of FIGS. 3A–3B, taken substantially in the direction of the arrows 5—5 in FIG. 3B.

With reference now to the illustrative drawings, and particularly to FIG. 1, there is shown a portable cart 11 carrying a set of sixteen golf clubs 13 having three distinct head styles, for use by a golfer and/or a fitting professional working with the golfer in selecting a particular club that is optimized for the golfer's particular swing. In the case of driver-type golf clubs, the three distinct head styles all have volumes of at least 300 cc volume each, preferably differing from each other by at least 20 cc.

Figure 2A:
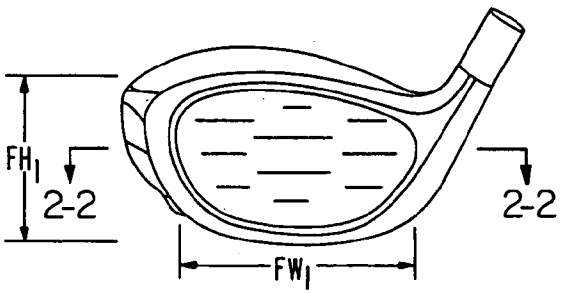
FIG. 2A is a front elevational view of a driver embodying a first of three head styles included in the preferred set of golf clubs of FIG. 1.
Figure 2B:
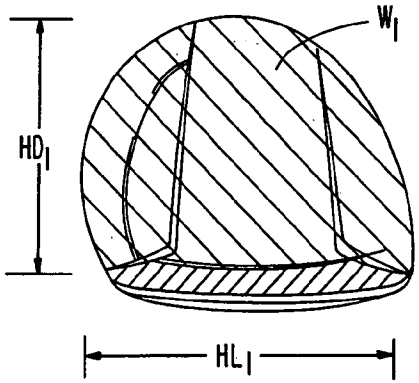
FIG. 2B is a sectional view of the driver of FIG. 2A, taken substantially in the direction of the arrows 2—2 in FIG. 2A.
Figure 4A:
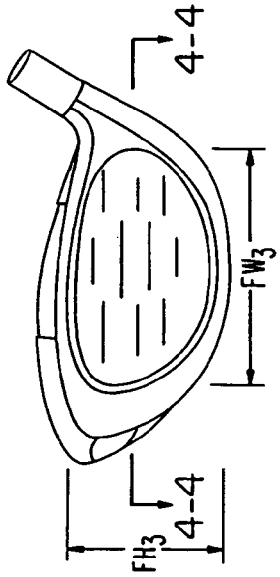
FIG. 4A is a front elevational view of a driver embodying a third of three head styles included in the preferred set of golf clubs of FIG. 1.
Figure 4B:
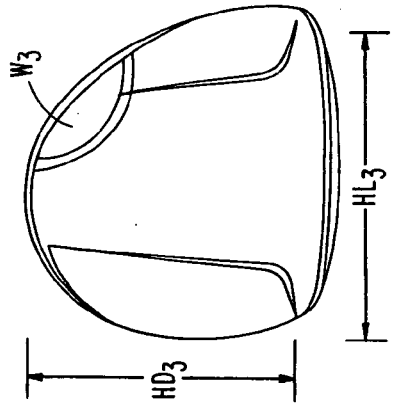
FIG. 4B is a sectional view of the driver of FIG. 4A, taken substantially in the direction of the arrows 4—4 in FIG. 4A.
Figure 3A:
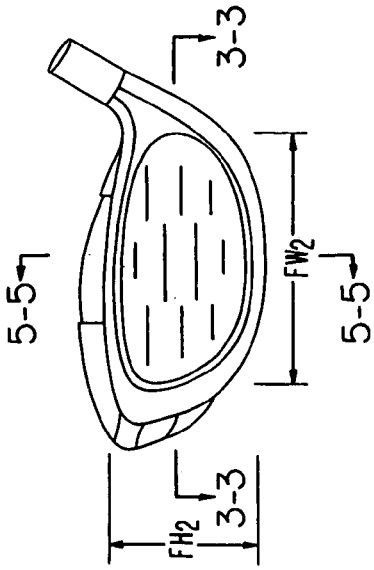
FIG. 3A is a front elevational view of a driver embodying a second of three head styles included in the preferred set of golf clubs of FIG. 1.
Figure 3B:
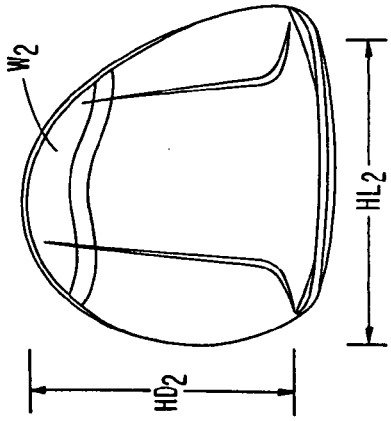
FIG. 3B is a sectional view of the driver of FIG. 3A, taken substantially in the direction of the arrows 3—3 in FIG. 3A.
Figure 6:
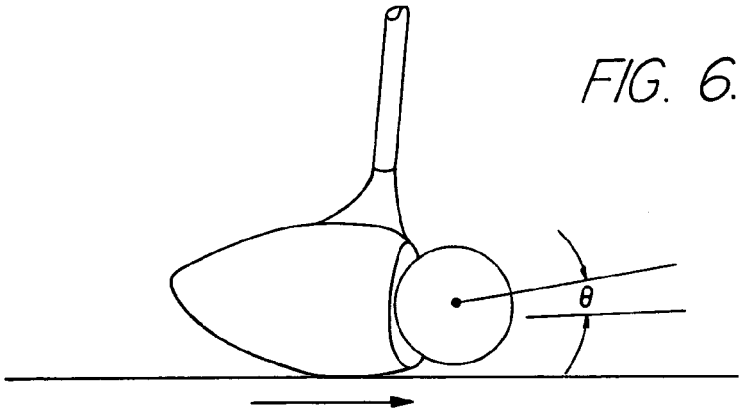
FIG. 6 is an elevational view of a golf club head, taken from the head's toe side, as the club head is striking a golf ball.

The three head styles of the set of golf clubs 13 are distinguishable from each other not only by differences in their head volumes, but also by differences in their address planforms, for example. The address planform is the view of the club head as seen by the golfer at address. The three head styles of one preferred set are depicted in FIGS. 2A–2B, 3A–3B, and 4A–4B. Specifically, the first style club head is depicted in FIGS. 2A–2B, the second style club head is depicted in FIGS. 3A–3B, and the third style club head is depicted in FIGS. 4A–4B.

The planform views of the three club head styles change not only according to the specific shape of the club's head, but also according to the actual dimensions of the club's head depth (HD) and head length (HL). These head dimensions, along with the club head's face width (FW) and face height (FH) dimensions, differ between the three head styles. Differences in the three head styles can be expressed by any of the following ratios: (1) face aspect ratio, FW/FH, (2) head aspect ratio, HL/HD, and (3) face height to head depth ratio, FH/HD. These head dimensions are shown in FIGS. 2A–2B, 3A–3B, and 4A–4B.

Another distinction between the three club head styles can be provided by adding mass in the sole region of the club heads. Specifically, and as shown in FIGS. 2B, 3B and 4B, a weight pad $W_1$, $W_2$ or $W_3$, respectively, of selected size can be placed at a selected location on the sole, to alter the club head's center of gravity and moment of inertia. The three head styles further can each include a variety of loft angles $\phi$ and a variety of shaft flex types.

Table I lists the preferred ranges for these various parameters, for the three head styles of the preferred set of golf clubs 13, for both a set of drivers and a set of fairway woods.

TABLE I

Preferred Ranges for Head Styles

| Type of Golf Club | Fairway Woods | Drivers |
|---|---|---|
| Volume (cc) | 120–200 | 300–400 |
| Face Height, FH (mm) | 30–45 | 45–65 |
| Face Width, FW (mm) | 65–90 | 75–100 |
| Head Length, HL (mm) | 85–105 | 100–120 |
| Head Depth, HD (mm) | 50–80 | 70–90 |
| Face Height to Head Depth Ratio, FH/HD | 0.35–0.90 | 0.50–0.95 |
| Face Aspect Ratio, FW/FH | 1.4–3.0 | 1.15–2.25 |

While having differences to accommodate the needs of different types of golfers and their swing characteristics, the three head styles are nonetheless readily identifiable as produced by the same source or manufacturer. That is, an engraving is provided on each club head, to identify the clubs as belonging together. The engraving may include, for example, a brand marking or logo, and/or a scoreline pattern. The three head styles also preferably have the same finish, including painted and polished sections of the heads. Alternatively, only two of the three head styles may have a common engraving or finish.

Other source identifiers, such as crown, sole or hosel designs, also can be used. The construction of the three head styles preferably is the same, such as a cast body of a titanium alloy, with a face plate welded at a front of the head.

Table II, below, identifies several parameters for one preferred set of sixteen drivers, namely, head size, loft angle, and shaft flex. As indicated in the first two columns of the table, clubs identified as #1 through #14 are designed for right-handed golfers, while clubs identified as #15 and #16 are for left-handed golfers. The third column identifies the club's head volume, either 300 cc, 320 cc or 360 cc. The fourth column identifies the club's shaft flex, with TS signifying "Tour Stiffness," S signifying "Stiff," R signifying "Regular," and L signifying "Ladies." The fifth column identifies the type of shaft for each club, either TM Tour, Pro Lite, TM Lite, El-70, or TM Ultra Lite. Finally, the sixth column of the table identifies the club head's loft angle $\theta$, either 7.5°, 8.5°, 9.5°, 10.5° or 12°.

TABLE II

Preferred Set of Sixteen Golf Clubs

| Club # | Hand (RH/LH) | Head Size (cc) | Shaft Flex | Shaft Type | Loft (°) |
|---|---|---|---|---|---|
| # 1 | RH | 300 | TS | TM TOUR | 7.5 |
| # 2 | RH | 300 | S | TM TOUR | 8.5 |
| # 3 | RH | 300 | S | PRO LITE | 9.5 |
| # 4 | RH | 320 | R | TM LITE | 9.5 |
| # 5 | RH | 300 | S | TM TOUR | 9.5 |
| # 6 | RH | 300 | S | EI-70 | 8.5 |
| # 7 | RH | 320 | S | PRO LITE | 9.5 |
| # 8 | RH | 320 | R | TM LITE | 10.5 |
| # 9 | RH | 320 | L | TM LITE | 12 |
| # 10 | RH | 360 | R | TM ULTRA LITE | 10.5 |
| # 11 | RH | 360 | S | TM ULTRA LITE | 9.5 |
| # 12 | RH | 320 | S | TM LITE | 9.5 |
| # 13 | RH | 360 | S | TM ULTRA LITE | 8.5 |

TABLE II-continued

Preferred Set of Sixteen Golf Clubs

| Club # | Hand (RH/LH) | Head Size (cc) | Shaft Flex | Shaft Type | Loft (°) |
|---|---|---|---|---|---|
| # 14 | RH | 360 | R | TM ULTRA LITE | 12 |
| # 15 | LH | 300 | S | TM TOUR | 8.5 |
| # 16 | LH | 320 | S | TM LITE | 9.5 |

Method for Fitting One Preferred Set of Golf Clubs

The club fitting method of the invention now will be described with reference to Table III, below. In an initial step of the method, the golfer selects a particular golf club having a medium head size, a medium loft angle, and a medium shaft flex, and then test-swings the club several times (e.g., five or six times) while the club head speed is measured (e.g., using a Beltronics Speed Analyzer). Based on the golfer's average measured club head speed during these test swings, an expected initial ball speed is calculated. The first two columns of Table III set forth a correlation between club head speed and expected ball speed. Alternatively, the actual ball speed could be measured during the golfer's test swings.

TABLE III

Initial Performance Parameters Optimizer Chart

| Swing Speed (mph) | Calculated Ball Speed (mph) | Launch Angle Goal (°) | Spin Rate Goal (rpm) | Recommended Driver # | Validation Drivers When Recommended # is: Too | OK | Too |
|---|---|---|---|---|---|---|---|
| 110 | 165 | 12–14 | 2500 | # 1 | | 6, 2 | 13, 12, 5 |
| 105 | 158 | 12–14 | 2500–2800 | # 2 | 1 | 3, 13, 7 | 5, 12 |
| 100 | 150 | 12–14 | 2800 | # 5 | 2, 3 | 12, 7, 13 | 4, 11, 8 |
| 95 | 143 | 12–14 | 2800–3000 | # 12 | 2, 3 | 11, 7 | 10, 4, 8 |
| 90 | 135 | 12–14 | 3000 | # 12 | 5, 13, 7 | 11 | 10, 4, 8 |
| 85 | 128 | 14–16 | 3000 | # 4 | 13 | 11 | 10, 14, 8 |
| 80 | 120 | 14–16 | 3000–3500 | # 8 | 12, 4 | 10 | 9, 14 |
| 75 | 113 | 16–18 | 3000–3500 | # 9 | 8, 10 | 14 | * |
| 70 | 105 | 18 | 3500 | # 9 | 8, 10 | 14 | * |

Based on the expected ball speed that is calculated or measured, a determination of the optimal ball launch angle and spin rate is made. Golf balls having a particular initial speed will travel furthest if launched at this optimal launch angle and with this optimal spin rate. With reference again to Table III, the third and fourth columns of the table identify these optimal values for a range of initial ball speeds.

Each of the drivers listed in Table II is known to provide a particular launch angle and ball spin rate, when the club is swung at a predetermined speed. Therefore, as the next step of the method, a selection is made of the particular club from the set of Table II that is preliminarily expected to provide the optimal launch angle and ball spin rate for the golfer's calculated or measured ball speed.

This selection is made using the fifth column of Table III, which sets forth the particular drivers that are expected to provide the launch angles and spin rates set forth in the third and fourth columns of the table. If, for example, the golfer's average measured swing speed is 95 mph, which translates to an expected ball speed of 143 mph, then the optimal launch angle is calculated to be 12–14° and the optimal spin rate is calculated to be 2800–3000 rpm. Based on that determination, and using Table II as the guide, a selection would be made of driver #12. This selection constitutes an initial recommendation of the golfer's properly fitted club.

The golfer then tests the particular club identified as being the initial recommendation of a properly fitted club, specifically by hitting a number of golf balls and noting the balls' trajectories. Depending on those trajectories, the golfer then uses the three "validation drivers" columns of Table III, i.e., the sixth, seventh and eighth columns, to test alternative drivers. These alternative drivers vary slightly in head size, loft angle, and/or shaft flex from that of the initial club recommendation.

More particularly, if the golfer's test hits, using the initially recommended club, show that the balls generally follow a trajectory considered to be good, then reference is made to the middle column of the three validation driver columns, i.e., the seventh column of Table III. That column identifies one to three alternative drivers for the golfer to test. The parameters for these alternative drivers are very close to those of the initially recommended driver.

In the example of an initially recommended driver that is #12 in the set of drivers, based on a measured swing speed of 95 mph, the middle column identifies driver #numbers 11 and 7 as being suitable alternatives to test. As indicated in Table II, driver #11 differs from driver #12 in that it has a larger head size (360 cc instead of 320 cc) and a slightly more flexible shaft flex (Stiff TM Ultra Lite instead of Stiff TM Lite). Driver #7 differs from driver #12 only in that it has a slightly stiffer shaft flex (Stiff Pro Lite instead of Stiff TM Lite). One of these two alternative drivers might prove to be more effective for the golfer, i.e., provide a more optimum fit. Test hitting of drivers other than the initially recommended driver and the identified validation drivers should not be necessary.

On the other hand, if the golfer's test hits, using the initially recommended club, show that the balls generally follow a trajectory considered to be too high, then reference is made to the left column of the three validation driver columns, i.e., the sixth column of Table III. That column identifies one to three alternative drivers for the golfer to test. The parameters for these alternative drivers are close to those of the initially recommended driver, but generally vary in the direction of a smaller head size, a shallower loft angle, and/or a stiffer shaft.

Thus, in the example of an initially recommended driver that is #12 in the set of drivers, based on a measured swing speed of 95 mph, the left column identifies driver #s 2 and 3 as being suitable alternatives to test. As indicated in Table II, driver #2 differs from driver #12 in that it has a smaller head size (300 cc instead of 320 cc), a slightly stiffer shaft flex (i.e., Stiff TM Tour instead of Stiff TM Lite), and a slightly lower loft angle (8.5° instead of 9.5°). Driver #3 differs from driver #12 in that it has a smaller head size (300 cc instead of 320 cc) and a slightly stiffer shaft flex (i.e., Stiff Pro Lite instead of Stiff TM Lite). One of these alternative drivers might prove to be more effective for the golfer, i.e., provide a more optimum fit. Test hitting of drivers other than the initially recommended driver and the identified validation drivers should not be necessary.

Further, if the golfer's test hits using the initially recommended club show that the balls generally follow a trajectory considered to be too low, then reference is made to the right column of the three validation driver columns, i.e., the eighth column of Table III. That column identifies two to three alternative drivers for the golfer to test. The parameters for these alternative drivers are close to those of the initially recommended driver, but generally vary in the direction of a larger head size, a steeper loft angle, and/or a more flexible shaft.

Thus, in the example of an initially recommended driver that is #12 in the set of drivers, based on a measured swing speed of 95 mph, the right column identifies driver #s 10, 4 and 8 as being suitable alternatives to test. As indicated in Table III, driver #10 differs from driver #12 in that it has a larger head size (360 cc instead of 320 cc), a slightly more flexible shaft flex (i.e., Regular TM Ultra Lite instead of Stiff TM Lite), and a slightly greater loft angle (10.5° instead of 9.5°). Driver #4 differs from driver #12 only in that it has a slightly more flexible shaft flex (i.e., Regular TM Lite instead of Stiff TM Lite). Driver #8 differs from driver #12 in that it has a slight more flexible shaft flex (i.e., Regular TM Lite instead of Stiff TM Lite) and a slightly greater loft angle (10.5° instead of 9.5°). One of these alternative drivers might prove to be more effective for the golfer, i.e., provide a more optimum fit. Test hitting of drivers other than the initially recommended driver and the identified validation drivers should not be necessary.

Alternatively, one or more swing characteristics of the golfer may be used to determine the optimal golf club. That is, other measurements may be taken directly or indirectly calculated in the present invention. Selection and purchase of the optimal club may occur without additional test swings for validation. These measurements include, but are not limited to, video-based measurements of hand speed and rotation, for example. In another embodiment, a reference golf club (not shown) having one or more sensors, such as accelerometers and strain gauges; located in or on the club, may be used to obtain alternative measurement, such as the club head acceleration at impact with the golf ball and club rotation during the golfer's downswing.

Alternative Sets of Golf Clubs

As mentioned above, the variety of head styles from which an optimum golf club can be selected according to the present invention is not limited to head sizes of 300 cc or greater; the head styles also can include fairway-wood golf clubs having head volumes of 120 cc or greater. The selection of golf clubs thus can include one portable fitting cart 11 (see FIG. 1) holding fairway woods and another fitting cart holding drivers. The coefficient of restitution for the club heads to be fitted is at least 0.8 and affords the opportunity for a golfer to be fitted for all of his wood-type golf club needs, while obtaining the highest performance through the fitting of the present invention.

Preferred values for three styles of fairway woods making up one preferred set of golf clubs are shown in Table IV, and preferred values for three styles of drivers making up one preferred set of golf clubs are shown in Table V.

TABLE IV

Preferred Dimensions for Three Styles of Fairway Woods

| | | | |
|---|---|---|---|
| Volume (cc) | 150 | 150 | 200 |
| Face Height, FH (mm) | 35.9 | 33.1 | 40.2 |
| Face Width, FW (mm) | 71 | 75.3 | 85.3 |
| Head Length, HL (mm) | 94.7 | 96 | 101.3 |
| Head Depth, HD (mm) | 59.2 | 62.5 | 69.7 |
| Face Height to Head Depth Ratio, FH/HD | 0.61 | 0.53 | 0.58 |
| Face Aspect Ratio, FW/FH | 1.98 | 2.27 | 2.12 |

TABLE V

Preferred Dimensions for Three Styles of Drivers

| | | | |
|---|---|---|---|
| Volume (cc) | 330 | 350 | 390 |
| Face Height, FH (mm) | 54.7 | 50.7 | 60.3 |
| Face Width, FW (mm) | 84.6 | 87.5 | 85.3 |
| Head Length, HL (mm) | 102.9 | 110.8 | 104.6 |
| Head Depth, HD (mm) | 78.3 | 84.2 | 83.6 |
| Face Height to Head Depth, FH/HD | 0.7 | 0.60 | 0.72 |
| Face Aspect Ratio, FW/FH | 1.55 | 1.73 | 1.41 |

Many golfers presently are accustomed to using fairway woods having club heads formed of steel, while others have embraced newer and somewhat more expensive fairway woods having club heads formal of titanium. To further accommodate this difference in preference (and performance), the three head styles offered in the fitting can include two heads having bodies of a stainless steel and one head of a titanium alloy, or two heads of titanium and one head of steel. The use of different materials may further result in different uses of weight pads or plugs and/or casting techniques. For example, the body of one head style may comprise casting with a front opening for a face plate and the body of another head style may comprise casting with an opening for a sole plate.

Another preferred embodiment of golf clubs for use in carrying out the fitting method of the invention includes the feature of swing weighting. The swing weighting may comprise a hosel plug that is inserted during manufacture of the golf clubs to achieve the final design head weights. Alternatively the swing weighting may include a custom weight insert for further fine-tuning to the golfer's requirements.

The hosel plug may be constructed in accordance with co-pending and commonly assigned U.S. application Ser. No. 09/881,361, filed Jun. 13, 2001, and entitled "Golf Club Head and Method for Making It." The custom swing weight may be as disclosed in commonly assigned U.S. Pat. No. 6,458,044, filed Jun. 13, 2001, and entitled "Golf Club Head and Method for Making It."

Figure 7:
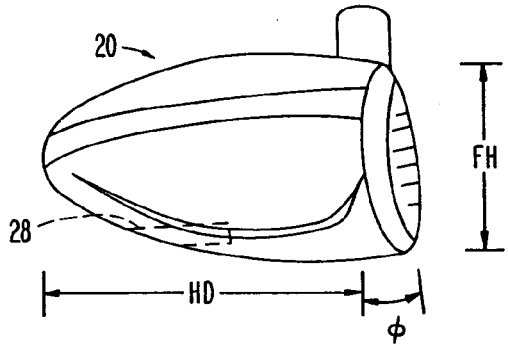
FIG. 7 is an elevational view of a golf club head, taken from the head's toe side, showing the club head's face height FH, head depth HD, and loft angle $\phi$.
Figure 8:
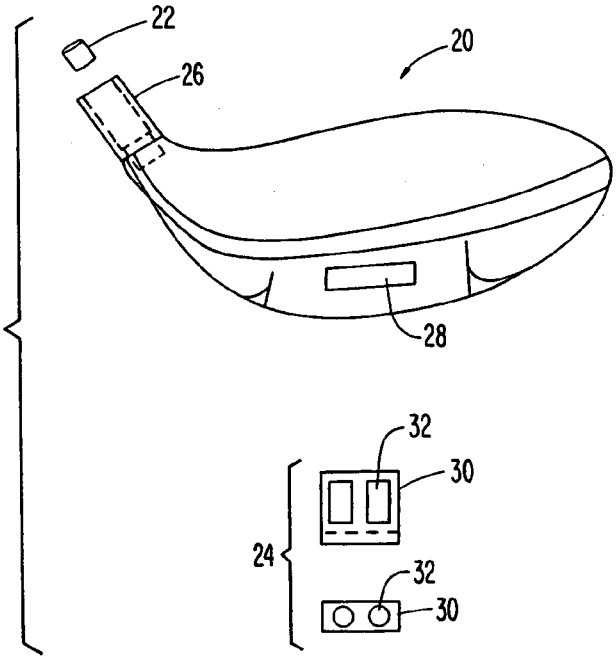
FIG. 8 is an exploded elevational view of the golf club head of FIG. 7, taken from the head'rear side, showing a weight cartridge that is insertable into a recess formed in the club head'rear wall.

A golf club head 20 incorporating both a hosel plug 22 and a custom swing weight 24 is shown in FIGS. 7 and 8. The hosel plug is sized to be positioned and retained within the golf club's hosel 26. The custom swing weight is sized to be positioned and retained within a special recess 28 formed in the club head's rear wall. The custom swing weight has the form of a polymeric weight cartridge 30 having predetermined dimensions. The additional mass provided by the cartridge may be determined by the number of tungsten rods 32 embedded within the polymer cartridge, or alternatively by variations in the polymeric material or weight rod(s).

It should be appreciated from the foregoing description that the present invention provides a formal, objective procedure for guiding golfers and/or their fitting professionals toward the selection of a particular wood-type golf club that is optimally matched or fitted to each golfer's particular swing characteristics.

Although the invention has been described with reference only to the preferred methods, those skilled in the art will appreciate that various modifications can be made without departing from the invention. Accordingly, the invention is defined only by the following claims.

We claim:

1. A method of fitting a wood-type golf club for a golfer, comprising:

a) providing a set of at least three golf clubs having different head styles, each head style having a head volume of at least 300 cc, the head styles including at least two different face height to head depth ratios and having a common manufacturing source;

b) determining a value for at least a first swing characteristic for the golfer; and c) selecting an optimal golf club from the set of golf clubs, such selection being based on at least the value of the first swing characteristic.

2. A method of selecting a wood-type golf club for a golfer from a plurality of golf clubs having at least three different head styles, each having a head volume of at least 300 cc, comprising:

a) selecting a first golf club having a first head style a first loft angle, and a first shaft flex;

b) swinging the first golf club more than one time to obtain a value representing at least a first swing characteristic;

c) selecting a second golf club based upon the value representing at least the first swing characteristic, the second golf club having a second head style, a second loft angle, and a second shaft flex;

d) swinging the second golf club to bit a plurality of golf balls and obtain a value representing a second swing characteristic;

e) swinging a third golf club to hit a plurality of additional golf balls and obtain a value representing a third swing characteristic, to validate the selection of the second golf club, the third golf club having a third head style a third loft angle, and a third shaft flex; and f) selecting an optimal golf club from the plurality of golf clubs, the optimal golf club having a first, second or third head size style, a first, second or third loft angle, and a first, second or third shaft flex;

wherein the first, second and third head styles comprise at least two different head volumes differing by at least 20 cc and at least two different ratios of face height to head depth, the first, second and third golf clubs having a common head finish to indicate a single manufacturing source.

3. The method of claim 2, wherein the second and third swing characteristics are the same.

4. The method of claim 2, wherein the value for at least the first swing characteristic is an average swing speed of the golfer.

5. The method of claim 4, wherein the value of the second characteristic is a ball launch angle or a spin rate.

6. The method of claim 5, wherein a relationship between the average swing speed, optimal ball launch angle, and spin rate is predetermined, such that steps c) and e) comprise referring to a chart.

7. The method of claim 2, wherein a relationship between the value representing at least the first swing characteristic and the value representing the second swing characteristic is predetermined, such that step c) comprises referring to a chart.

8. The method of claim 7, wherein the plurality of golf clubs are numbered sequentially, for selection of the second and third golf clubs, the numbered clubs being referenced by the chart.

9. The method of claim 2, and further comprising swinging a fourth golf club having a fourth head style, a fourth loft angle, and a fourth shaft flex, to validate the selection of the second golf club, the optimal golf club comprising an optimal head style is corresponding to the first, second, third or fourth head style, an optimal loft angle corresponding to the first, second, third or fourth loft angle, and an optimal shaft flex corresponding to the first, second, third or fourth shaft flex.

10. The method of claim 9, and further comprising swinging a fifth golf club having a fifth head style, a fifth loft angle, and a fifth shaft flex, to validate the selection of the second golf club, the optimal golf club comprising an optimal head style corresponding to the first, second, third, fourth or fifth head style, an optimal loft angle corresponding to the first second, third, fourth or fifth loft angle, and an optimal shaft flex corresponding to the first, second, third, fourth or fifth shaft flex.

11. The method of claim 2, and further comprising applying face tape to the first golf club and using information from a dispersion pattern that is produced on the face tape after the first golf club is swung a plurality of times, to aid in selecting the optimal golf club.

12. A method of selecting a wood-type golf club for a golfer, the head of the golf club baying a volume of at least 300 cc, comprising:

a) providing a plurality of golf clubs having at least three different head styles, each having a different volume, the golf clubs having a substantially similar engravings on their heads, to indicate a common source;

b) determining a value for at least a first swing characteristic for the golfer; and c) selecting an optimal golf club from the plurality of golf clubs based on at least the first swing characteristic;

wherein the at least three different head styles comprise head volumes differing by at least 20 cc between each and at least two different ratios of face height to head depth, the plurality of golf clubs having a common head finish to indicate a single manufacturing source.

13. The method of claim 12, and further comprising providing a cart to hold the plurality of golf clubs.

14. The method of claim 12, wherein the substantially similar engravings comprise a scoreline pattern on the face of the head of each of the plurality of golf clubs.

15. The method of claim 12, wherein the substantially similar engravings comprise a brand marking or logo on the head of each of the plurality of golf clubs.

16. The method of claim 12, wherein the heads of the plurality of golf clubs have a substantially common construction.

17. The method of claim 16, wherein the substantially common construction comprises a cast body and a face plate welded to a front opening of the cast body.

18. The method of claim 16, wherein the substantially common construction comprises a common material for at least a body portion of each club head.

19. The method of claim 12, wherein the different head styles comprise at least two different address planforms, the planforms including a difference in size or shape or both.

20. The method of claim 12, wherein the different head styles further comprise at least two different face aspect ratios.

21. The method of claim 12, wherein the different head styles further comprise at least two different weight pads, the weight pads differing in size or location or both.

22. A method of selecting a wood-type golf club for a golfer, the golf club having a coefficient of restitution value of at least 0.8, the method comprising:

a) providing a plurality of golf clubs having at least three head styles, the at least three head styles comprising at least two different weight pads providing different centers of gravity and at least two different ratios of face height to head depth, the golf clubs having heads that comprise substantially similar engravings, to indicate a common source;

b) determining a value for at least a first swing characteristic for a golfer; and c) selecting an optimal golf club from the plurality of golf clubs based on at least the first swing characteristic.

23. The method of claim 22, wherein the substantially similar engravings comprise a scoreline pattern on the face of the bead of each of the plurality of golf clubs.

24. The method of claim 22, wherein the substantially similar engravings comprise a brand marking or logo on the head of each of the plurality of golf clubs.

25. The method of claim 22, wherein the heads of the plurality of golf clubs have a similar finish.

26. The method of claim 22, wherein the heads of the plurality of golf clubs have a substantially common construction.

27. The method of claim 26, wherein the substantially common construction comprises a cast body and a face plate welded to a front opening of the cast body.

28. The method of claim 26, wherein the substantially common construction comprises a recess located on the exterior of a body portion of the club head of each of the plurality of golf clubs, the recess fixedly receiving a swing weight.

29. The method of claim 26, wherein the substantially common construction comprises an insert located in a hosel portion of the club head of each of the plurality of golf clubs.

30. The method of claim 22, wherein the weight pads further differing in size or location or both.

31. The method of claim 22, wherein the head styles further comprise at least two different materials for the club heads of the plurality of golf clubs.

32. The method of claim 31, wherein:

at least one of the first, second and third golf clubs includes a club head that comprises a titanium alloy; and at least one of the first, second and third golf clubs includes a club head that comprises a stainless steel alloy.

33. A method of selecting a wood-type golf club for a golfer, the golf club having a coefficient of restitution value of at least 0.8, the method comprising:

a) providing a plurality of golf clubs having at least three head styles, the at least three head styles comprising at least two different weight pads providing different centers of gravity and at least two different ratios of face height to head depth, the golf clubs having heads that comprise substantially similar engravings, to indicate a common source, a recess being formed on the exterior of a body portion of each of the heads, the recess fixedly receiving a swing weight;

b) determining a value for at least a first swing characteristic of the golfer; and c) selecting an optimal golf club from the plurality of golf clubs based on at least the first swing characteristic.

34. A method of selecting a wood-type golf club for a golfer, the golf club having a coefficient of restitution value of at least 0.8, the method comprising:

a) providing a plurality of golf clubs having at least three head styles, the at least three head styles comprising at least two different weight pads providing different centers of gravity and at least two different ratios of face height to head depth, the golf clubs having heads that comprise substantially similar engravings, to indicate a common source, and further comprising an insert in a hosel portion of each head;

b) determining value for at least a first swing characteristic for the golfer; and c) selecting an optimal golf club from the plurality of similar golf clubs based on at least the first swing characteristic.

* * * * *

UNITED STATES PATENT AND TRADEMARK OFFICE

CERTIFICATE OF CORRECTION

PATENT NO. : 7,147,570 B2
APPLICATION NO. : 09/949212
DATED : December 12, 2006
INVENTOR(S) : Toulon et al.

It is certified that error appears in the above-identified patent and that said Letters Patent is hereby corrected as shown below:

On the Title page, at Inventors item 75, please change the third inventor's name to -- Austin Jackson Bonar --. Please delete "A.J. Bonar" and replace with --Austin Jackson Bonar--

Column 3, line 28, "head" should be -- head's --.

Column 5, line 30 in Table III, after "Too", insert -- High --.

, after "OK", insert -- Try # --.

, after "Too" (second occurrence), insert -- Low --.

Column 6, line 1, "Table II" should be -- Table III --.

, line 23, "#numbers" should be -- numbers --.

Column 7, line 52, "measurement" should be -- measurements --.

Column 8, line 32, "formal" should be -- formed --.

Column 9, line 42, "bit" should be -- hit --.

, line 52, after "head", delete "size".

Column 10, line 18, after "style" delete "is".

, line 38, "baying" should be -- having --.

UNITED STATES PATENT AND TRADEMARK OFFICE

CERTIFICATE OF CORRECTION

PATENT NO. : 7,147,570 B2
APPLICATION NO. : 09/949212
DATED : December 12, 2006
INVENTOR(S) : Toulon et al.

It is certified that error appears in the above-identified patent and that said Letters Patent is hereby corrected as shown below:

Column 11, line 29, “bead” should be -- head --.

Signed and Sealed this

Twenty-fourth Day of April, 2007

JON W. DUDAS
*Director of the United States Patent and Trademark Office*